US005107642A

United States Patent [19]

Mogstad

[11] Patent Number: 5,107,642

[45] Date of Patent: Apr. 28, 1992

[54] ARRANGEMENT IN SCREENING OF OBJECTS, ESPECIALLY RESIDENTIAL HOUSES

[75] Inventor: Tore Mogstad, Notodden, Norway

[73] Assignee: Isola A/S, Notodden, Norway

[21] Appl. No.: 611,169

[22] Filed: Nov. 8, 1990

[30] Foreign Application Priority Data

Jun. 12, 1989 [NO] Norway ..... 894899

[51] Int. Cl.[5] ..... E02D 3/10

[52] U.S. Cl. ..... 52/169.5; 52/169.14

[58] Field of Search ..... 52/169.5, 169.14

[56] References Cited

FOREIGN PATENT DOCUMENTS 0107188 7/1965 Norway ..... 52/169.5

OTHER PUBLICATIONS

Radon Reduction Techniques for Detached Houses, EPA, Jun. 1986, pp. 18, 29.

*Primary Examiner*—David A. Scherbel
*Assistant Examiner*—Wynn E. Wood
*Attorney, Agent, or Firm*—Morgan & Finnegan

[57] ABSTRACT

An arrangement for the protection of a building structure, especially residential houses, from the intrusion of fluids, especially unpleasant or detrimental gas, comprising by providing around a portion of the foundation wall (4) a foundation wall membrane (1) having an irregular surface, and at the top thereof being sealed (3) against the outer surface of the foundation wall, and further comprising a ventilation channel (2) which is connected to means (7, 8) for the removal of said fluids in a direction away from said foundation wall (4) and the associated basement.

7 Claims, 1 Drawing Sheet

ARRANGEMENT IN SCREENING OF OBJECTS, ESPECIALLY RESIDENTIAL HOUSES

FIELD OF THE INVENTION

The present invention relates to an arrangement for the protection of houses from the intrusion of fluids, especially unpleasant or detrimental gases.

BACKGROUND OF THE INVENTION

Generally, the present invention relates to the protection of houses against the intrusion of any type of unwanted fluids, but the invention is especially developed in connection with the radon protection of the basement wall of houses having a basement.

Radon gas from the ground will, when the concentration is high, penetrate into the building structure and may according to the concentration constitute a health danger.

It is presumed that the alpha radiation which is present in this connection, represents the second largest reason for lung cancer compared with tobacco smoking.

The applicant has for several years developed a system for solving the problem of humidity/smell in houses without basement, and has arrived at a ventilated floor system based on his product of a foundation wall protective membrane. The solution to this problem regarding smell/moisture has been successful, and in 1987 the applicant became involved in the development of radon protection, based on very much of the same thoughts as supporting the previous work and including mechanical ventilation of floors in houses without basements.

The work is now completed, and the results have proven positive. In the present solution it is possible to reduce the contents of radon in the house far below the suggested limiting values.

The above mentioned radon protection is made for houses without basements. However, in Norway in which the building tradition involves mainly houses with basement, such a solution will not be satisfactory, since the basement walls may here be up to 2 m high, and are provided below the ground.

PRIOR ART AND DISADVANTAGES RELATED THERETO

There have been suggested various methods for preventing radon gas from the ground to penetrate into the building. Such solutions have included the sealing of the building structure and also so-called radon wells in which radon gas is sucked out from the loose mass before it can penetrate into the building structure.

This so-called "radon trap" is a similar method in which it is aimed for providing an underpressure in the drainage mass below the basement floor. However, said existing solutions are hampered with uncertain features. It is very difficult to seal off the building structure by sealing cracks etc., since the latter after a while may redevelop due to settlement in the ground. Consequently, the success of the radon well and the radon trap is dependent on the condition of the mass.

DISCLOSURE OF THE PRESENT INVENTION AND THE SOLUTION PROVIDED THEREIN

The foundation wall protective membrane of the applicant comprises an air, gas and moisture proof plastic membrane including a plurality of knobs. The design of the membrane provides an air gap between the membrane and the structure against which it is mounted. The membrane is to a larger degree used as a moisture preventing barrier in houses having basement. The membrane also offers the possibility for drying the concrete of the structure even after the drainage mass has been put back against the outer surface of the basement wall.

What is characteristic for the present solution appears from the enclosed patent claims, and the following description taken in connection with the attached drawing.

BRIEF DISCLOSURE OF THE DRAWING

The enclosed drawing illustrates a cutout of a basement wall, in which an embodiment of the present invention is included.

DETAILED DESCRIPTION OF EMBODIMENT

Figure 1:
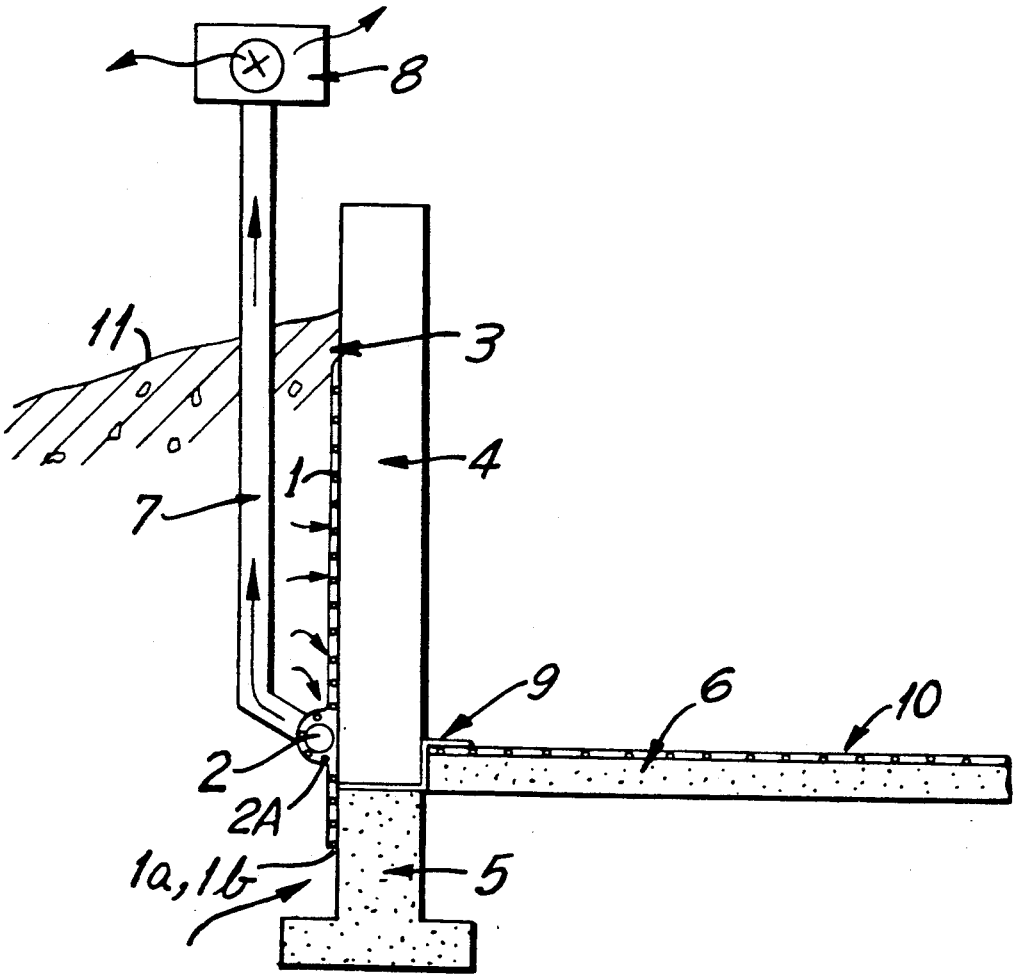

The present invention is based on the use of the above discussed foundation wall membrane 1, but then including top sealings 3 as well as the use of a ventilation channel 2 at the lower part of said membrane 1. The ventilation channel is connected with a fan 8 as appearing from the enclosed FIGURE.

The membrane 1 is at the upper edge thereof sealed against the foundation wall 4 due to the one or more sealings 3. In a similar manner all the vertical joints of the membrane are sealed.

The ventilation channel 2 which is provided with holes 2A will at an appropriate location be connected to a vertical pipe 7 leading to the fan 8. The fan 8 will develop an underpressure between the foundation wall membrane 1 and the wall 4, such that a possible throughput of air will be in the direction from the basement and outwards, and not from the drainage mass 11 and inwards. This will prevent the intrusion of radon from the masses around the basement walls. The underpressure in the ventilation channel 2 will also remove the gas which will pass between the foundation wall membrane 1 and the foundation wall where an opening 1*b* exists at the lower edge la thereof.

The system providing for outer radon protection of the basement wall will be combined with an inner radon protection of the floor as developed by the applicant in connection with houses without basement, and will thus provide for a total solution to the radon protection of houses having a basement.

In addition, the foundation wall protecting membrane 1 of the applicant will still function according to its basic principle, namely for moisture protection of the basement.

In summary the present invention may be characterized by said arrangement comprising an impervious foundation wall membrane having an irregular surface and being mounted around a portion of the foundation wall, said wall membrane at the top thereof being sealed against the outer surface of said foundation wall and comprising a ventilation channel which is connected to means for the removal of fluids in a direction away from said foundation wall and associated basement, especially a combined removal of moisture and unpleasant or detrimental gases.

The foundation wall membrane 1 with the irregular surface is shaped so as to hold a substantially horizontally arranged channel 2 provided with holes 2A and being located at the lower part of the membrane 1. Although the foundation wall membrane 1 is sealed against the foundation wall 4 at the top 3 thereof, it is open along its lower edge 1*a*, said lower edge 1*a* being provided below said channel 2.

The upper edge of the membrane 1 including the sealing 3 is provided just below the surface of the drainage mass 11, whereas the lower edge 1*a* of the foundation wall membrane 1 is provided below the basement floor 6.

Between the inner surface of the foundation wall 4 and the inner floor 6, i.e. in the area between the bottom of the foundation wall 4 and footing 5, there is provided a second sealing 9 and the lower portion 1*a* of the outer foundation wall membrane 1 reaches below said inner sealing 9. On top of the inner floor 6 there is provided a second protective impervious membrane 10 having knobs facing the upper surface of said floor.

Consequently, the above system provides a total solution for the protection of a house having a basement against the intrusion of unwanted fluids, especially gases from the ground or the drainage mass, and especially radon gas.

The fan 8 and the associated discharge means are located or adapted such that the unwanted, discharge gas will have their detrimental effects reduced to a minimum.

In other words, the present invention provides a system which protects residential houses against the intrusion of fluids, and this protection is valid especially against a) moisture existing in the surrounding masses, b) gases having unpleasant odours, for example methane, and c) other detrimental gases, for example radon.

The present system will therefore provide a combined protection against the intrusion of fluids as such, from the outside, but will nevertheless give a possibility for the drying of the protected part of the concrete structure, especially during the curing period of the concrete foundation walls.

I claim:

1. An arrangement in screening of objects, especially residential houses from intrusion of fluids, said arrangement comprising an impervious foundation wall membrane (1) having an irregular surface and which is mounted around a portion of a foundation wall (4), said wall membrane (1) being sealed (3) at the top thereof against an outer surface of said foundation wall (4) and being shaped so as to hold a ventilation channel (2) at a lower part of said wall membrane, said ventilation channel being connected to means (7, 8) for the removal of fluids in a direction away from said foundation wall (4), especially a combined removal of moisture and unpleasant detrimental gases.

2. Arrangement as claimed in claim 1, wherein the foundation wall membrane (1) having the irregular surface, comprises a substantially horizontally arranged channel (2), arranged at the lower part (1*a*) of said membrane (1) and being provided with holes (2A) and being connected to a substantially vertical pipe (7) which can be connected to a fan (8), preferably for developing an underpressure between said foundation wall membrane (1) and the foundation wall (4).

3. Arrangement as claimed in claim 1 or 2, wherein the foundation wall membrane (1) is sealed against the foundation wall (4) along the upper edge portion (3) thereof around the overall foundation wall, and that the foundation wall membrane (1) is open along its lower edge (1*a*) which is at a lower level than the ventilation channel (2).

4. Arrangement as claimed in claim 1 wherein the upper edge (3) of the foundation wall membrane (1) is provided just below the surface of the drainage mass 11, and that the lower edge (1*a*) of the foundation wall membrane (1) is provided below the inner basement floor (6).

5. Arrangement as claimed in claim 4, wherein between the foundation wall (4) and a footing (5) thereof there is provided a second sealing (9), and that the lower edge (1*a*) of the foundation wall membrane (1) on the outer side of the foundation wall (4) reaches below said inner sealing (9).

6. Arrangement as claimed in claim 1 wherein the above system is included in a total solution for the protection of houses having basements against the intrusion of unwanted fluids, especially gases from the ground or the drainage mass, and especially radon gas.

7. Arrangement as claimed in claim 1 wherein the fan (8) and the associated discharge means are located or adapted such that unwanted discharged gases will have their detrimental effects reduced to a minimum.

* * * * *